United States Patent [19]

Hori et al.

[11] 4,201,586

[45] May 6, 1980

[54] PHOTOGRAPHIC LIGHT-SENSITIVE MATERIAL

[75] Inventors: Kiyotaka Hori; Shigeru Nagatomo, both of Ashigara, Japan

[73] Assignee: Fuji Photo Film Co., Ltd., Ashigara, Japan

[21] Appl. No.: 848,630

[22] Filed: Nov. 4, 1977

Related U.S. Application Data

[63] Continuation of Ser. No. 587,590, Jun. 16, 1975, abandoned.

[30] Foreign Application Priority Data

Jun. 17, 1974 [JP] Japan ..... 49/68945

[51] Int. Cl.[2] ..... G03C 1/76

[52] U.S. Cl. ..... 430/621; 430/950; 430/631; 430/642; 430/541

[58] Field of Search ..... 96/50 PL, 74, 114, 114.5, 96/114.7, 114.8, 67, 111

[56] References Cited

U.S. PATENT DOCUMENTS

| | | | |
|---|---|---|---|
| 3,291,611 | 12/1966 | Krajewski | 96/114 |
| 3,551,151 | 12/1970 | Malan | 96/74 |
| 3,589,906 | 6/1971 | McDowell | 96/114.5 |
| 3,666,478 | 5/1972 | Groh et al. | 96/114.5 |
| 3,676,123 | 7/1972 | Stephens | 96/50 PL |
| 3,754,924 | 8/1973 | DeGeest et al. | 96/114.5 |
| 4,018,609 | 4,1977 | Lohmer et al. | 96/50 PL |

FOREIGN PATENT DOCUMENTS

| | | | |
|---|---|---|---|
| 68850 | 10/1973 | Poland | 96/114.7 |

OTHER PUBLICATIONS

McGraw et al., Gelatin Mixtures Research Disclosure, (England), #12541, 9–74.

Chem. Abstract, vol. 56, #12 (1961), Sep. of the Solid Phase of Gelatin, Byull. Izo. #5568.

*Primary Examiner*—J. Travis Brown

*Attorney, Agent, or Firm*—Sughrue, Rothwell, Mion, Zinn and Macpeak

[57] ABSTRACT

A photographic light-sensitive material having improved anti-adhesive properties comprising an uppermost layer containing acid-processed gelatin and a surface active organic fluoro-compound.

9 Claims, No Drawings

PHOTOGRAPHIC LIGHT-SENSITIVE MATERIAL

This is a continuation of application Ser. No. 587,590, filed June 16, 1975, now abandoned.

BACKGROUND OF THE INVENTION

1. Field of the Invention

The present invention relates to a photographic light-sensitive material having improved anti-adhesive properties. More particularly, it relates to a silver halide photographic light-sensitive material whose surface anti-adhesive properties are improved.

2. Description of the Prior Art

A conventionally used silver halide photographic material has a surface layer containing a hydrophilic colloid such as gelatin as a binder. Therefore, the adhesiveness or tackiness of the surface of such a photographic material increases in an atmosphere of high humidity, especially under the circumstances of a high temperature and a high humidity, to result in easy adhesion to another material with which the photographic material comes into contact. Various disadvantages often occur due to this adhesion phenomenon which takes place between different parts of a photographic material or between a photographic material and another material when they are allowed to stand in contact with each other in the course of either the photographic material, taking a photograph, processing the photographic material, projecting the photographic material, or storing the photographic material.

In order to solve such a problem, the so-called matt layer-making method is well known to those skilled in the art, wherein the presence of a fine powder of an inorganic compound such as silicon dioxide, magnesium oxide, titanium dioxide, calcium carbonate, etc., or the presence of a fine powder of an organic compound such as polymethylmethacrylate, cellulose acetate propionate, etc., in the surface layer causes the coarseness of the surface to increase, thereby resulting in a decrease in the adhesiveness of the surface. However, such a matt layer-making method is accompanied by some undesirable side effects as described below. Namely, a homogeneously coated-layer can not be obtained because the above-described fine powders easily aggregate in the coating solution, a photographic material containing the above-described fine powders in a surface layer tends to be damaged and is harder to drive in a camera or a projector than if the above-described fine powders were not present because of the decrease in the slipping ability of the surface, the transparency of the photographic material after processing is reduced due to the presence of the above-described fine powders in a surface layer, the granularity of the image is degraded by the presence of the above-described fine powders in the surface layer, and the like.

Accordingly, a method for improving the anti-adhesive properties and obtaining photographic materials which are free from the above-described disadvantages has been desired.

SUMMARY OF THE INVENTION

An object of the present invention is to provide a photographic material having improved anti-adhesive properties.

Another object of the present invention is to provide a method for improving the anti-adhesive properties of a photographic material.

A still further object of the present invention is to provide a method for improving the anti-adhesive properties without impairing other photographic properties.

Other objects of the present invention will become apparent from the following detailed description.

It has now been found that the above-described objects are accomplished by incorporating an acid-processed gelatin and a surface active organic fluoro-compound into an uppermost layer of a photographic light-sensitive material.

Thus the photographic light-sensitive material of the present invention includes an uppermost layer containing acid-processed gelatin and a surface active organic fluoro-compound. By practicing the present invention, a photographic light-sensitive material having remarkably improved anti-adhesive properties without impairing other photographic properties such as the transparency and the granularity of the image, and the like can be obtained.

DETAILED DESCRIPTION OF THE INVENTION

The acid-processed gelatin used in the present invention is a gelatin which is produced by treatment with hydrochloric acid, etc., in the production from any collagenous stock, which is different from lime-processed gelatin which is produced by processing of any collagenous stock with lime conventionally used in the photographic industry. Processes for producing such gelatin and properties thereof have been described in detail in Arther Veis, *The Macromolecular Chemistry of Gelatin,* pages 187–217, Academic Press, (1964). Although differences appear in gel strength, swelling rate, dissolving rate, viscosity, the greatest difference in these gelatins is that the isoelectric point of the acid-processed gelatin is a pH of about 6.0 to 9.5 while that of the lime-processed gelatin is a pH of about 4.5 to 5.3.

The surface active organic fluoro compound (hereinafter organic fluoro compound for brevity) which is used in the present invention has surface active properties. The surface active properties required for the organic fluoro compound used in the present invention are for the surface tension of a 1 N aqueous sodium hydroxide solution to be decreased about 20 dyne/cm$^2$ or more at 25° C., when the organic fluoro compound is dissolved in the solution in a ratio of 1 g of the organic fluoro compound per 100 ml of the solution.

The organic fluoro-compound which can be employed in the present invention includes those compounds having a chain structure or a cyclic structure and containing at least three fluorine atoms and at least three carbon atoms. These compounds, of course, can further contain elements other than fluorine and carbon.

Of the organic fluoro-compounds, compounds having a group in which at least three carbon atoms combine to form carbon-carbon bonds and, the carbon-carbon bonds containing the three carbon atoms are bonded to at least three fluorine atoms in total are particularly useful. In these compounds another carbon atom or atoms can or can not have fluorine atom or atoms.

Typical examples of organic fluoro-compounds which can be used in the present invention are illustrated below.

(1) $CF_3(CF_2)_6COONH_4$ (2) $CF_3(CF_2)_9(CH_2)_{10}COOH$

-continued (3) $CF_3(CF_2)_5(CH_2)_{10}COONa$ (4) $Cl-CF_2(CF(Cl)-CF_2)_4COOH$ (5) $H(CF_2)_{10}COONa$ (6) $HOOC(CF_2-CF(Cl))_4COOH$ (7) $Cl(CF_2-CF(Cl))_3CF_2-COOK$ (8) $CF_3(CF_2)_6CH=CH(CH_2)_3COONa$ (9) $CF_3(CF_2)_3CF(CF_3)(CH_2)_{10}COONa$ (10)

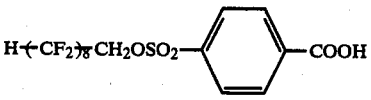

(11) $CF_3(CF_2)_7CO-N(CH_3)(CH_2)_2COONa$

(12) $Cl(CF_2)_6COONa$

(13) $CF_3(CF_2)_3CH_2CH_2-SO_2-N(C_2H_5)-CH_2-COONa$

(14) $CF_3(CF_2)_7SO_2-N(C_2H_5)-CH_2-COOK$

(15) $CF_3(CF_2)_7SO_2-N(C_3H_7)-CH_2-COOK$

(16) $CF_3(CF_2)_6CO-N(C_2H_5)-(CH_2)_2SO_3K$

-continued (17)

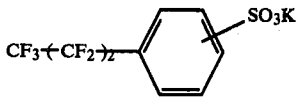

(the $-SO_3K$ group can be present at the ortho-, meta- or para-position or a mixture thereof)

(18)

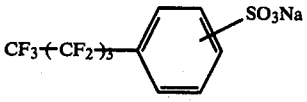

(the $-SO_3Na$ group can be present at the ortho-, meta- or para-position or a mixture thereof)

(19) $CF_3(CF_2)_7SO_3K$

(20) $CF_3(CF_2)_{11}-CH_2-OSO_3Na$

(21) $CF_3(CF_2)_6COO(CH_2)_3SO_3Na$

(22) $H(CF_2)_6CH_2-O(CH_2)_3SO_3Na$

(23) $NaO_3S-CH(CH_2-COOCH_2(CF_2)_6H)-COOCH_2(CF_2)_6H$

(24) $C_{16}H_{33}-CH(SO_3Na)-COOCH_2-CF_3$

(25) $C_{16}H_{33}-CH(SO_3Na)-CONHCH_2(CF_2)_2H$

(26) $CF_3(CF_2)_7SO_2-N(CH_3)-CH_2CH_2OSO_3H$ (27)

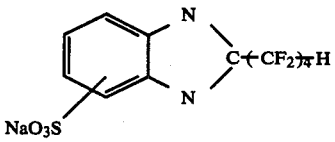

(the $-SO_3Na$ group can be present at the 4- or 5-position or a mixture thereof)

(28) $C_8F_{17}SO_2-N(C_2H_5)-CH_2-CH_2-O-P(=O)(OH)_2$

(29) $H(CF_2)_8O-P(=O)(ONa)_2$

(30) $CF_3(CF_2)_{12}COO(CH_2CH_2O)_{20}H$

(31) $CF_3(CF_2)_6CO-N(CH_3)(CH_2)_2O(CH_2CH_2O)_4H$

(32) $CF_3(CF_2)_7SO_2-N(C_2H_5)(CH_2)_2O(CH_2CH_2O)_{20}H$

(33) $CF_3(CF_2)_8COO(CH_2CH_2-O)_8CH_3$

(34) $CF_3(CF_2)_7COO(CH_2CH_2-O)_{15}CH_3$

-continued

(35) $CF_3(CF_2)_6COO(CH_2-\underset{\underset{CH_3}{|}}{CH}-O)_4(CH_2CH_2O)_{10}H$

(36) $CF_3(CF_2)_6COO(CH_2-\underset{\underset{CH_3}{|}}{CH}-O)_4(CH_2CH_2O)_{20}H$

(37) $CF_3(CF_2)_6COO(CH_2-\underset{\underset{CH_3}{|}}{CH}-O)_3(CH_2-CH_2-O)_{10}(CH_2)_4CH_3$

(38) $CF_3(CF_2)_7SO_2NH(CH_2)_3\overset{+}{N}(CH_3)_3 \cdot I^-$ (39)

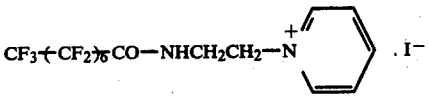

(40) $CF_3(CF_2)_6CONH(CH_2)_3-\overset{+}{\underset{\underset{CH_3}{|}}{\overset{\overset{CH_3}{|}}{N}}}-CH_2CH_2-COO^-$

(41) $CF_3(CF_2)_7SO_2-NHCH_2CH_2-\overset{+}{\underset{\underset{CH_2CH_3}{|}}{\overset{\overset{CH_2CH_3}{|}}{N}}}-CH_2-COO^-$

(42) $CF_3-\underset{\underset{C_2F_5}{|}}{\underset{\underset{C_2F_5}{|}}{C}}-\underset{\underset{CH_2O(CH_2CH_2O)_7H}{|}}{C}-CHF-CF_3$

(43) $CF_3-\underset{\underset{C_2F_5}{|}}{\underset{\underset{C_2F_5}{|}}{C}}-\underset{\underset{COO(CH_2CH_2O)_7H}{|}}{C}-CHF-CF_3$

(44) $CF_3-\underset{\underset{C_2F_5}{|}}{\underset{\underset{C_2F_5}{|}}{C}}-\underset{\underset{COONa}{|}}{C}-CHF-CF_3$

(45) $CF_3-\underset{\underset{C_2F_5}{|}}{C}-\underset{\underset{CF_3}{|}}{CH}-\underset{\underset{CF_3}{|}}{CF}-COONa$

(46) $CF_3-\underset{\underset{C_2F_5}{|}}{C}-\underset{\underset{CF_3}{|}}{CH}-\underset{\underset{CF_3}{|}}{CF}-CONH(CH_2)_3\overset{+}{N}(CH_3)_3Cl^-$ (47)

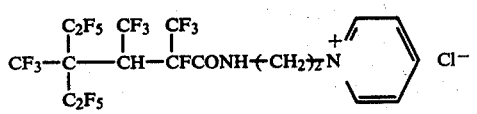

(48) $CF_3\underset{\underset{C_2F_5}{|}}{\underset{\underset{C_2F_5}{|}}{C}}-\underset{\underset{SO_3Na}{|}}{C}-CHF-CF_3$

(49) $CF_3-\underset{\underset{C_2F_5}{|}}{\underset{\underset{C_2F_5}{|}}{C}}-\underset{\underset{CF_3}{|}}{CH}-\underset{\underset{CF_3}{|}}{CF}-SO_3Na$ (50)

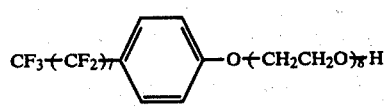

-continued

(51) $F\text{-}(CF(CF_3)\text{-}CF_2O)_7\text{-}CF(CF_3)CONH\text{-}(CH_2)_3N\text{-}(CH_3)_2 \rightarrow O$

(52) $C_8F_{17}SO_2NHC_2H_5$ (53)

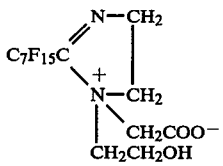

(54)

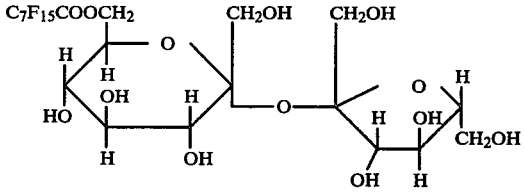

(55)

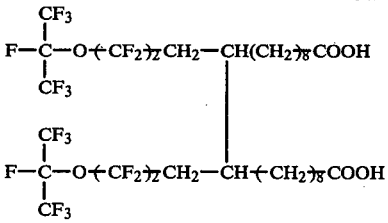

The fluoro-compounds which can be used in the present invention can be prepared according to methods as disclosed in, for example, U.S. Pat. Nos. 2,559,751; 2,567,011; 2,732,398; 2,764,604; 2,806,866; 2,809,998; 2,915,376; 2,915,528; 2,934,450; 2,937,098; 2,957,031; 3,472,894 and 3,555,089, Japanese Patent Publication Nos. 37304/1970 and 9613/1972, *J. Chem. Soc.*, page 2789(1950); ibid, page 2574 (1957) and ibid, page 2640(1957), *J. Amer. Chem. Soc.*, vol. 79, page 2549(1957), and *J. Japan Oil Chemist's Soc.*, vol. 12, page 653(1964).

Some of the above organic fluoro-compounds are commercially available under the trade names, for example, of Megafac F (e.g., F-110 ($C_8F_{17}SO_3K$),F-120 ($C_8F_{17}SO_2N(C_3H_7)\text{-}CH_2COOK$), F-144 ($C_8F_{17}SO_2N(C_3H_7)CH_2CH_2O\text{-}(CH_2CH_2O)_n\text{-}H$ where n = 20 ), F-150 ($C_8F_{17}SO_2NH(CH_2)_3N^+(CH_3)_3\ I^-$),ect.), trade name, manufactured by Dai-Nippon Ink & Chemicals, Inc.;

FC(e.g., FC-95,FC-128 ($C_8F_{17}SO_2N(C_2H_4)\text{-}CH_2COOK$),

FC-134 ($C_8F_{17}SO_2NH(CH_2)_3N^+(CH_3)_3\ I^-$),

FC-161, FC-170, FC-176, FC-430, FC-431, etc.), trade name manufactured by Minnesota Mining Mfg. Co.; Monflor (e.g., Monflor-31, -32, -51, -52, -53, -71, -91, etc.) trade name, manufactured by Imperial Chemical Ind. Ltd.; Zonyl S (e.g., S-13) trade name, manufactured by E. I. Dupont; and Licowet VPE manufactured by Farbwerke Hoechst A. G.

The use of organic fluoro-compounds in photographic light-sensitive materials is described, for example, in U.S. Pat. Nos. 3,589,906 and 3,666,478, German patent application (OLS) Nos. 1,942,665; 1,961,638 and 2,124,262 and Japanese patent application (OPI) No. 9715/1973. However, the present invention is based on the discovery that the anti-adhesive properties of photographic materials are surprisingly improved using the combination of acid-processed gelatin and an organic fluoro-compound, and thus it is clearly distinguished in its method, objects and effects from these prior known approaches.

The amount of the organic fluoro-compound employed in the uppermost layer according to the present invention is not particularly limited, but when the amount is excessively small, the anti-adhesive properties are not sufficiently improved. On the other hand when the amount is excessivey large, some disadvantages, for example, foam in a processing solution, etc. occur. The organic fluoro compound is preferably used, therefore, in an amount of about 0.1 to about 10 g per 100 g of the total amount of binder in the uppermost layer. The organic fluoro-compounds used in the present invention are characterized in that they have surface active properties as described above and thus they provide much larger antiadhesive effects in comparison with organic fluoro-compounds which do not have surface active properties. It is believed that organic fluoro-compounds having surface active properties are effectively oriented at the surface of the layer in comparison with those which do not have surface active properties.

The binder in the uppermost layer of the photographic light-sensitive material according to the present invention can be composed of either pure acid-processed gelatin or a mixture of acid-processed gelatin and other polymers. However, the amount of the acid-processed gelatin is preferably more than about 20% by weight based on the total weight of the binders in the uppermost layer to obtain sufficiently the effects according to the present invention. Any compounds known in the photographic art can be used as other polymers. Examples of these polymers include hydrophilic polymers, for example, chemically unmodified gelatin such as alkali-processed gelatin and enzyme-processed gelatin which are particularly preferred. Other hydrophilic polymers, for example, include proteins such as albumin, casein, etc.; polysaccharide derivatives such as agar, dextran, gum arabic, starch, carboxymethyl starch, etc.; cellulose derivatives such as carboxymethyl cellulose, hydroxyethyl cellulose, carboxymethyl hydroxyethyl cellulose, etc.; and synthetic hydrophilic polymers such as polyvinyl alcohol, partially hydrolyzed polyvinyl acetate, polyvinyl pyrrolidone, polyacrylamide, polyacrylic acid, copolymers of maleic anhydride and other vinyl compounds, etc. can be also advantageously used individually or as a combination thereof. Further a homopolymer or copolymer latex dispersed in water which is prepared from monomers selected from alkylacrylates, alkylmethacrylates, acrylic acid, methacrylic acid, sulfoalkylacrylates, sulfoalkylmethacrylates, glycidyl acrylate, glycidyl methacrylate, hydroxyalkylacrylates, hydroxyalkylmethacrylates, alkoxyalkylacrylates, alkoxyalkylmethacrylates, styrene, butadiene, vinyl chloride, vinylidene chloride, maleic anhydride and itaconic anhydride as described, for example, in U.S. Pat. Nos. 2,376,005; 2,739,137; 2,853,457; 3,062,674; 3,411,911; 3,488,708; 3,525,620; 3,635,715; 3,607,290 and 3,645,740, and British Pat. Nos. 1,186,699 and 1,307,373, etc., can be used. If desired, the so-called grafttype emulsion polymerization latexes, which are prepared from the above vinyl compounds by emulsion polymerization in the presence of a hydrophilic protective colloid, can be employed individually or in combination with other hydrophilic polymers. Furthermore, a mixture of the above-described polymers can be used. In these cases it is desired to take into consideration conditions such as pH, mixing ratio, etc. in the systems in order to prevent a coagulation of the acid-processed gelatin and other polymers.

The objects of the present invention can be much more preferably accomplished by using a matting agent additionally in an uppermost layer containing the acid-processed gelatin and the organic fluoro-comound. As matting agents, fine particles of water-insoluble organic or inorganic materials having particle sizes of from about 0.2 to 5 microns, particularly 0.5 to 3 microns, are suitable. Examples of organic materials which can be suitably used include water dispersable vinyl polymers such as polymethyl acrylate, polymethyl methacrylate, polyacrylonitrile, acrylonitrile-α-methylstyrene copolymers, polystryene, syrenedivinylbenzene copolymers, polyvinyl acetate, polyethyleneterephalate, polycarbonate or polytetrafluoroethylene, etc., cellulose acetate or cellulose acetate propionate, etc., starch, starch derivatives such as carboxy starch, carboxy nitrophenyl starch or urea-formaldehyde starch reaction products, gelatin hardened with known hardening agents, and hardened microcapsulated hollow particles of gelatin produced by coacervation. Examples of inorganic materials which can be suitably used include silicon dioxide, titanium dioxide, magnesium oxide, aluminum oxide, barium sulfate, calcium carbonate, silver chloride and silver bromide, and glass etc. These matting agents can be employed individually or as a mixture of two or more thereof, if desired.

As an additional means for enhancing further the effect of the present invention, a suitable amount of a hardening agent or a lubricating agent can be used in the uppermost layer containing the acid-processed gelatin and the organic fluoro-compound. Addition of these additives to a photographic layer of conventional photographic light-sensitive materials is well known as a means of further exhibiting the function of the protective layer, and thus it is preferred in the present invention to use such additives in the uppermost layer for the same purpose. Namely, hardening agents are effective for suitably hardening the uppermost layer to retain the physical strength of the surface layer. Examples of suitable hardening agents include aldehyde type compounds such as formaldehyde or glutaraldehyde, ketone compounds such as diacetyl or cyclopentanedione, reactive halogen containing compounds such as bis-(2-chloroethylurea), 2-hydroxy-4,6-dichloro-1,3,5-triazine as well as the compounds as described in U.S. Pat. Nos. 3,288,775 and 2,732,303 and British Pat. Nos. 974,723 and 1,167,207, reactive olefin group containing compounds such as divinyl sulfone, 5-acetyl-1,3-diacryloylhexahydro-1,3,5-triazine as well as the compounds as described in U.S. Pat. Nos. 3,635,718 and 3,232,763 and British Pat. No. 994,869, N-methylol compounds such as N-hydroxymethyl phthalimide as well as the compounds as described in U.S. Pat. Nos. 2,732,316 and 2,586,168, isocyanates as described in U.S. Pat. No. 3,103,437, aziridine compounds as described in U.S. Pat. Nos. 3,017,280 and 2,983,611, acid derivatives as described in U.S. Pat. Nos. 2,725,294 and 2,725,295, carbodiimide compounds as described in U.S. Pat. No. 3,100,704, epoxy compounds as described in U.S. Pat. No. 3,091,537, isoxazole compounds as described in U.S. Pat. Nos. 3,321,313 and 3,543,292, halocarboxyaldehydes such as mucochloric acid, dioxane derivatives such as dihydroxydioxane or dichlorodioxane, and inorganic hardening agents such as chromium alum or zirconium sulfate, and the like. Further, precursors of hardener compounds such as alkali metal bisulfite-aldehyde adducts, methylol derivatives of hydantoin or primary aliphatic nitroalcohols, etc. can be used instead of the above described compounds.

The lubricating agents are not only useful for preventing adhesion because they have a similar function to the matting agents but also are effective for improving the friction characteristics when used in a camera during photographing or upon projection of movie films. Examples of lubricating agents which can be suitably used include waxes such as liquid paraffin or esters of long chain fatty acids, polyfluorohydrocarbons or derivatives thereof, silicones such as polyalkyl polysiloxanes, polyaryl polysiloxanes, polyalkylaryl polysiloxanes or the alkyleneoxide adducts thereof, etc.

Furthermore, surface active agents can be employed individually or as a mixture of two or more thereof to a dispersion comprising the uppermost layer. Although they are generally used as coating aids for preventing uneven coating, they can be utilized for other purposes such as for improvement of dispersion, prevention of the generation of electrostatic charges in the finished light-sensitive materials.

These surface active agents can be classified as natural surface active agents such as saponin, etc., nonionic surface active agents such as alkyleneoxide type, glycerin type or glycidol type surface active agents, etc., cationic surface active agents such as higher alkylamines, quaternary ammonium salts, pyridine or other heterocyclic compounds, phosphonium or sulfonium compounds, etc., anionic surface active agents containing acid groups such as carboxylic acid, sulfonic acid, phosphoric acid, sulfuric acid ester or phosphoric acid ester groups, etc., and amphoteric surface active agents such as aminoacids, aminosulfonic acids, or sulfuric or phosphoric acid esters of aminoalcohols, and the like.

Some examples of surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, and 3,545,974, German patent application (OLS) No. 1,942,665, British Pat. Nos. 1,077,317 and 1,198,450, Ryohei Oda et al, *Kaimenkasseizai no Gosei to sono Oyo,* Maki Shoten Co. (1964), A. M. Perry, *Surface Active Agents,* Interscience Publications Incorporated (1958) and J. P. Sisley, *Encyclopedia of Surface Active Agents,* Vol. 2, Chemical Publishing Company (1964).

In the present invention, the term "uppermost layer" means a layer which is positioned on a surface of the layers comprising a photographic light-sensitive material. The uppermost layer most commonly and preferably used is a protective layer or an overcoat on a protective layer. However, an intermediate layer, an antihalation layer or another layer which is not a surface layer in the finished product but is such during, e.g., production, can also be included in the uppermost layer in the sense of the present invention. That is, during production of the photographic light-sensitive material of the present invention, one or more layers are coated in order and the surface layer of such an unfinished product is considered to be an uppermost layer. Therefore, the uppermost layer of the present invention should not be considered as being limited to the protective layer or the overcoat on a protective layer of the finished material. The uppermost layer can be applied to both surfaces of a support. For instance, when silver halide emulsion layers are present on both surfaces of the support, the uppermost layers can be applied on each of the emulsion layers. It is preferred for the thickness of the uppermost layer to range from about 0.2 to about 5 microns, and preferably 0.5 to 3 microns.

Silver halide emulsions which can be used in the present invention can be produced by mixing a solution of a water-soluble silver salt (for example, silver nitrate) with a solution of a water-soluble halogen salt (for example, potassium bromide) in a solution of a water-soluble high molecular weight compound such as gelatin. As the silver halide, not only silver chloride and silver bromide but also mixed silver halides such as silver chlorobromide, silver iodobromide and silver chloroiodobromide can be used. The grains of the silver halide can have a cubic system, an octahedral system or a mixed crystal form. The grain size and the grain size distribution thereof is not limited but generally ranges from about 0.1$\mu$ to 5$\mu$.

These silver halide grains can be produced by known conventional methods, such as the so-called single jet process, double jet process or controled double jet process. Further, two or more silver halide photographic emulsions previously produced can be mixed. Still further, the silver halide particles can have any crystal structure, for example, a homogeneous structure, a laminar structure wherein the interior and the surface of the grains have different properties, or the so-called conversion type silver halide grains as described in British Pat. No. 635,841 and U.S. Pat. No. 3,622,318. Furthermore, they can be those grains wherein a latent image is formed mainly on the surface of the grains or those grains wherein the latent image is formed in the interior of the grains. These photographic emulsions have been described in C. E. K. Mees & T. H. James, *The Theory of the Photographic Process,* 3rd Ed MacMillan Co., New York (1966) and P. Glafkides, *Chemie Photographique,* Paul Montel Co., Paris (1957), and they can be produced by various known processes such as an ammonia process, a neutral process, an acid process, and the like.

After formation of the silver halide grains, they are washed with water in order to remove the by-produced water-soluble salts (for example, potassium nitrate when silver bromide is produced using silver nitrate and potassium bromide) from the system, and then they are subjected to a heat treatment in the presence of a chemical sensitizing agent such as sodium thiosulfate, N,N,N'-trimethylthiourea, a thiocyanate complex salt of monovalent gold, a thiosulfate complex salt of monovalent gold, stannous chloride or hexamethylenetetramine, etc. to increase the sensitivity without coarsening the grains. These processes have also been described in the above described literature references.

The silver halide emulsions can also be chemically sensitized using conventional methods. As chemical sensitizing agents, gold compounds such as chloroaurate or gold trichloride as described in U.S. Pat. Nos. 2,399,083, 2,540,085, 2,597,856 and 2,597,915, salts of noble metals such as platinum, palladium, iridium, rhodium or ruthenium as described in U.S. Pat. Nos. 2,448,060, 2,540,086, 2,566,245, 2,566,263 and 2,598,079, sulfur compounds which form silver sulfide by reacting with silver, salts as described in U.S. Pat. Nos. 1,574,944, 2,410,689, 3,189,458 and 3,501,313, and stannous salts, amines and another reducing materials as described in U.S. Pat. Nos. 2,487,850, 2,518,698, 2,521,925, 2,521,926, 2,694,637, 2,983,610 and 3,201,254 can be used.

It is possible to add various types of compounds in order to prevent a reduction of sensitivity or a generation of fog during the production of the light-sensitive materials, during the storage thereof or during the processing thereof. A large number of such compounds are known, for example, 4-hydroxy-6-methyl-1,3,3a,7-tetrazaindene, 3-methylbenzothiazole, 1-phenyl-5-mercaptotetrazole and many other heterocyclic compounds, mercury containing compounds, mercapto compounds and metal salts. Examples of compounds which can be used have been described not only in C. E. K. Mees & T. H. James, *The Theory of the Photographic Process, supra,* pages 344–349, but also in the following patents: U.S. Pat. Nos. 1,758,576, 2,110,178, 2,131,038, 2,173,628, 2,697,040, 2,304,962, 2,324,123 2,394,198, 2,444,605–8, 2,566,245, 2,694,716, 2,697,099, 2,708,162, 2,728,663–5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339, and British Pat. Nos. 893,428, 403,789, 1,173,609 and 1,200,188.

If desired, the photographic emulsions can be subjected to spectral sensitization or super sensitization using cyanine dyes such as cyanine, merocyanine or carbocyanine dyes or a combination of such cyanine dyes with styryl dyes. These spectral sensitization techniques are well known and have been described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Application (OLS) Nos. 2,030,326 and 2,121,780, Japanese Patent Publication Nos. 4936/1968, 14030/1969 and 10733/1968, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203, etc. These compounds can be selected depending on the purpose and use of the light-sensitive materials such as the wavelength range to be sensitized or the sensitivity desired, and the like.

In addition, the photographic light-sensitive emulsion layer can contain color couplers. Suitable color couplers include 4-equivalent diketomethylene type yellow couplers and 2-equivalent diketomethylene type yellow couplers, for example, the compounds as described in U.S. Pat. Nos. 3,415,652, 3,447,928, 3,311,476, and 3,408,194, the compounds as described in U.S. Pat. Nos. 2,875,057, 3,265,506, 3,409,439, 3,551,155 and 3,551,156, and the compounds as described in Japanese Patent Application (OPI) Nos. 26133/1972 and 66836/1973; 4-equivalent or 2-equivalent pyrazolone type magenta couplers or indazolone type magenta couplers, for example, the compounds as described in U.S. Patent Nos. 2,600,788, 2,983,608, 3,062,653, 3,214,437, 3,253,924, 3,419,391, 3,419,808, 3,476,560 and 3,582,322, Japanese Patent Publication No. 20636/1970 and Japanese Patent Application (OPI) No. 26133/1973; and α-naphthol type cyan couplers or phenol type cyan couplers, for example, the compounds as described in U.S. Pat. Nos. 2,474,293, 2,698,794, 3,034,892, 3,214,437, 3,253,924, 3,311,476, 3,458,315 and 3,591,383, and Japanese Patent Publication Nos. 11304/1967 and 32461/1969. In addition, the DIR couplers as described in U.S. Pat. Nos. 3,227,554, 3,297,445, 3,253,924, 3,311,476, 3,379,529, 3,516,831, 3,617,291 and 3,705,801 and German Patent Application (OLS) No. 2,163,811 can be used.

The photographic light-sensitive emulsions can contain a hardening agent and a surface active agent. These agents can be selected from the above-described chemical materials used for the uppermost layer containing the acid-processed gelatin and the organic fluoro-compound. The hardening agent is effective for increasing the physical strength of the light-sensitive emulsion layers or other layers by hardening suitably these layers. The surface active agent is used as a coating aid, for preventing uneven coating at application of the light-sensitive emulsion layers or other layers. However, it is sometimes used for other purposes, for example, for dispersion, sensitization, improvement of photographic properties, prevention of the formation of electrostatic charges and prevention of adhesion of the finished photographic light-sensitive materials, or can be used together with other additives in order to promote their functions.

These photographic emulsion layers and the uppermost layer are applied to substantially planar materials which do not undergo any severe dimensional changes during processings, for example, rigid supports such as glass, metal or ceramics or flexible supports. Typical flexible supports are cellulose nitrate films, cellulose acetate films, cellulose acetate butyrate films, cellulose acetate propionate films, polystyrene films, polyethylene terephthalate films, polycarbonate films, or laminated products of these films, thin glass films and paper. Further, paper coated or laminated with baryta or α-olefin polymers, particularly, polymers of α-olefins having 2 to 10 carbon atoms such as polyethylene, polypropylene or ethylene-butene copolymers, and synthetic resin films as described in Japanese Patent Publication No. 19068/1972 wherein the surface has been roughened so as to improve adhesion to other high molecular weight materials and to improve printability can also be used with good results.

A transparent support or an opaque support can be selected from these supports depending on the purpose of the light-sensitive materials. Further, not only colorless transparent supports but also colored transparent supports which are dyed by adding a dye or a pigment can be used. This has been practiced hitherto for X-ray films and is described in *J. SMPTE,* vol. 67, page 296 (1958). As the opaque support, intrinsically opaque materials such as paper, opaque films produced by adding a dye or a pigment such as titanium dioxide to transparent films, synthetic resin films the surface of which has been processed by the method described in Japanese Patent Publication No. 19068/1972, and light-shielding paper or synthetic resin films containing carbon black or a dye can be used. A layer which is adhesive to the support and the photographic emulsion layer can be employed as a subbing layer, if the adhesive strength between the emulsion layer and the support is insufficient. If desired, the surface of the support can be previously subjected to a corona discharge, a ultraviolet light application or a flame treatment, etc. in order to further enhance the adhesive property.

Each layer of the photographic light-sensitive material can be applied using various processes such as a dip coating process, an air knife coating process, a curtain coating process or an extrusion coating process using a hopper as described in U.S. Pat. No. 2,681,294. If desired, two or more layers can be applied at the same time by the process described in U.S. Pat. Nos. 2,761,791, 3,508,947, 2,941,898 and 3,526,528.

The photographic light-sensitive material of the present invention can be provided, as long as they have the uppermost layer containing the acid-processed gelatin and the organic fluoro-compound, with any photographic layers known in the art (for example, one or more silver halide emulsion layers, intermediate layers, filter layers, subbing layers, anti-halation layers, etc.). Accordingly, the photographic light-sensitive materials in accordance with the present invention include black-and-white photographic light-sensitive materials, for example, black-and-white films or papers, infra-red films, X-ray films, films for the graphic arts, glass plates, etc., and color photographic light-sensitive materials, for example, color positive films, color papers, color negative films and color reversal films, etc.

Where the photographic materials of the present invention are designed for black-and-white photography, they can be developed according to conventional methods. Suitable developing agents which can be used include 4-aminophenols such as 4-N-methylaminophenol hemisulfate (Metol), 4-N-benzylaminophenol hydrochloride, 4-N,N-diethylaminophenol hydrochloride and 4-aminophenol sulfate; 3-pyrazolidones such as 1-phenyl-3-pyrazolidone, 4,4-dimethyl-1-phenyl-3-pyrazolidone and 4-methyl-1-phenyl-3-pyrazolidone; polyhydroxybenzenes such as hydroquinone, 2-methylhydroquinone, 2-phenylhydroquinone, 2-chlorohydroquinone, pyrogallol and catechol; p-phenylenediamines such as p-phenylenediamine hydrochloride and N,N-diethyl-p-phenylene diamine sulfate; ascorbic acid and N-(p-hydroxyphenyl)glycine; and those described in C. E. K. Mees & T. H. James, *The Theory of the Photographic Process,* supra, Chapter 13, and L. F. A. Mason, *Photographic Processing Chemistry, pages* 16 to 30, Oxford Press (1966). Mixtures of these developing agents can also be used. The developing solutions can contain alkalis such as the hydroxides, carbonates or phosphates of alkali metals or ammonia; pH adjusting agents or buffers such as weak acids, e.g., acetic acid and boric acid, weak bases or their salts; developing accelerators (e.g., pyridinium compounds or cationic compounds such as those described in U.S. Pat. Nos. 2,648,604 and 3,671,247; potassium or sodium nitrate; nonionic compounds such as polyethylene glycol condensation products or their derivatives as described in U.S. Pat. Nos. 2,553,990, 2,577,127 and 2,950,970 and polythioethers represented by those described in British Pat. Nos. 1,020,033 and 1,020,032; organic amines; benzyl alcohol; and hydrazines); anti-fogging agents (e.g., alkali metal bromides or iodides; nitrobenzimidazoles as described in U.S. Pat. Nos. 2,496,940 and 2,656,271; mercaptobenzimidazole, 5-methylbenzotriazole and 1-phenyl-5-mercaptotetrazole; compounds for use in rapid processing solutions such as those described in U.S. Pat. Nos. 3,113,864, 3,342,596, 3,295,976, 3,615,522 and 3,597,199; thiosulfonyl compounds such as those described in British Pat. No. 972,211; phenazine-N-oxides such as those described in Japanese Patent Publication No. 41675/1971; and those described in *Kagaku Shashin Binran* (*Manual of Scientific Photography*), Vol. II, pages 29 to 47); stain or sludge preventing agents such as those described in U.S. Pat. Nos. 3,161,513 and 3,161,514; and British Pat. Nos. 1,030,442, 1,144,481 and 1,251,558; and preservatives such as sulfites, bisulfites, hydroxylamine hydrochloride, formsulfite and alkanolamine sulfite adducts.

The photographic materials can be subjected to a stopping, fixing or stabilization treatment, after developing. These processings can be carried out at a temperature of above 20° C. or, if desired, below 20° C., and in some cases above about 30° C., and preferably about 32° to about 60° C. Each of these processes need not necessarily be conducted at the same temperature.

Where the photographic materials of the present invention are those intended for color photography, they can be processed, after exposure, to form a color image. The process includes at least one color developing step and, optionally, pre-hardening, neutralization, a first development (black-and-white development) step and the like. These and subsequent steps, such as bleaching, fixing, blixing, stabilization and washing, can be carried out above or below 20° C., in some cases above about 30° C., preferably about 32° C. to about 60° C. Further, these steps need not necessarily be carried out at the same temperature.

A color developing solution is an alkaline aqueous solution having a pH of higher than about 8, preferably from 9 to 12, and containing as a developing agent a compound whose oxidized product is capable of forming a colored compound when reacted with a color-forming agent, i.e., a color-coupler, such as the p-phenylenediamines, e.g., N,N-diethyl-p-phenylenediamine, N,N-diethyl-3-methyl-p-phenylenediamine, 4-amino-3-methyl-N-ethyl-N-methanesulfonamidoethylaniline, 4-amino-3-methyl-N-ethyl-N-$\beta$-hydroxyethylaniline and N-ethyl-N-$\beta$-hydroxyethyl-p-phenylenediamine or the salts thereof such as the hydrochlorides, sulfates and sulfites. Other developing agents such as those described in U.S. Pat. Nos. 2,193,015 and 2,592,364; and Japanese Patent Application (OPI) No. 64933/1973 can also be used. The color developing solution can contain, in addition to the above-described compounds, salts such as sodium sulfate; pH adjusting agents or buffers such as sodium hydroxide, sodium carbonate, sodium phosphate, acetic acid or boric acid or the salts thereof; developing accelerators (e.g., pyridinium compounds or cationic compounds such as those described in U.S. Pat. Nos. 2,648,604 and 3,671,247; potassium or sodium nitrate; condensation products of polyethylene glycol and the derivatives thereof such as those described in U.S. Pat. Nos. 2,533,990, 2,577,127 and 2,950,970; nonionic compounds such as polythioethers represented by those described in British Pat. Nos. 1,020,033 and 1,020,032; polymeric compounds having sulfite ester groups such as those described in U.S. Pat. No. 3,068,097; organic amines such as pyridine and ethanolamine; benzyl alcohol and hydrazines). The color developing solutions can further contain anti-fogging agents (e.g., alkali metal bromides or iodides; nitrobenzimidazoles such as those described in U.S. Pat. Nos. 2,496,940 and 2,656,271; mercaptobenzimidazole; 5-methylbenzotriazole; 1-phenyl-5-mercaptotetrazole; compounds for use in rapid processing solutions such as those described in U.S. Pat. Nos. 3,113,864, 3,342,596, 3,295,976, 3,615,552 and 3,597,199; thiosulfonyl compounds such as those described in British Patent No. 972,211; phenazine-N-oxides such as those described in Japanese Patent Publication No. 41675/1971; and those described in *Kagaku Shashin Binran* (*Manual of Scientific Photography*), Vol. II, pages 29 to 47); sludge or stain preventing agents such as those described in U.S. Pat. Nos. 3,161,513 and 3,161,514; and British Pat. Nos. 1,030,442, 1,144,481 and 1,251,558; interlayer effect accelerators disclosed in U.S. Pat. No. 3,536,487; and preservatives such as sulfites, bisulfites, hydroxylamine hydrochloride and formaldehyde-alkanolamine-sulfite adducts.

The developing solution can also contain diffusible yellow couplers such as those described in U.S. Pat. Nos. 3,510,306 and 3,619,189; and Japanese Patent Publication Nos. 33775/1965 and 3644/1969; diffusible magenta couplers such as those described in German Patent Application (OLS) No. 2,016,587; U.S. Pat. Nos. 2,369,489; 2,600,788, 3,152,896 and 3,615,502; and Japanese Patent Publication No. 13111/1969; diffusible cyan couplers such as those described in U.S. Pat. Nos. 3,002,836 and 3,542,552; and British Pat. No. 1,062,190.

Prior to the color developing step, the color photographic materials are conventionally treated with a pre-hardening solution. As a prehardening solution, a solution containing at least one aldehyde compound, which exerts a hardening effect on gelatin which is a constituent of the photographic emulsions, for example, aliphatic aldehydes such as those described in U.S. Pat. No. 3,232,761; formaldehyde; glyoxal; succinaldehyde; glutaraldehyde; pyruvaldehyde; and aromatic aldehydes such as those described in U.S. Pat. Nos. 3,565,632 and 3,677,760, is commonly employed. The solution can also contain inorganic salts such as sodium sulfate; pH adjusting agents or buffers such as borax, boric acid, acetic acid, sodium acetate, sodium hydroxide and sulfuric acid; and development fog inhibitor such as alkali metal halides, e.g., potassium bromide.

In general, a neutralizing bath is used in order to protect the color developing solution against contamination by the aldehydes used in the pre-hardening solution. The neutralizing baths contain aldehyde-removing agents such as hydroxylamine and λ-ascorbic acid, and other additives such as inorganic salts, pH adjusting agents or buffers.

In the case of color reversal films, a first development is also carried out prior to the color development. A solution containing at least one developing agent, such as hydroquinone, 1-phenyl-3-pyrazolidone, N-methyl-p-aminophenol and the like can be employed as the first development solution. The solution can also contain inorganic salts such as sodium sulfate; pH adjusting agents or buffers such as borax, boric acid, sodium hydroxide and sodium carbonate; developing fog inhibitors such as an alkali metal halide, e.g., potassium bromide, and the like.

The compounds illustrated above and the amounts thereof employed are well known in the field of color processing.

After color development, the color photographic materials are usually bleached and fixed. The processes can be effected in a blix bath which combines the bleaching and fixing baths. Many compounds can be used as a bleaching agent, including ferricyanides; bichromates; water-soluble iron (III) salts; water-soluble cobalt (III) salts; water-soluble Copper (II) salts; water-soluble quinones; nitrosophenols; complexes of an organic acid and a polyvalent cation such as iron (III), cobalt (III) and copper (II), e.g., metal complexes of aminopolycarboxylic acids such as ethylenediaminetetraacetic acid, nitrilotriacetic acid, iminodiacetic acid and N-hydroxyethylethylenediaminetriacetic acid, malonic acid, tartaric acid, malic acid, diglycolic acid and dithioglycolic acid, and the copper complex of 2,6-dipicolinic acid; peracids such as alkylperacids, persulfates, permanganates and peroxides; hypochlorites; chlorine; and bromine, individually or in combination. Bleaching accelerators such as those described in U.S. Pat. Nos. 3,042,520 and 3,241,966; and Japanese Patent Publication Nos. 8506/1970 and 8836/1970 can also be used.

Any known fixing solution can be used for fixing. That is, ammonium, sodium or potassium thiosulfate can be used as a fixing agent at a concentration of about 50 to 200 g/liter. Fixing solutions can further contain stabilizers such as sulfites and metabisulfites; hardning agents such as potassium alum; buffers such as acetates and borates, and the like. Fixing solutions have a pH of about 3–12.

Additional details concerning bleaching agents, fixing agents and blixing baths are described in U.S. Pat. No. 3,582,322, etc.

The photographic materials can be stabilized according to the methods described, for example, in U.S. Pat. Nos. 2,515,121, 2,518,686, 3,140,177, etc.

The present invention will now be further illustrated in greater detail by reference to the following examples. However, the present invention is not to be construed as being limited to these examples.

EXAMPLE 1

To a subbed cellulose triacetate film support, a red-sensitive silver halide emulsion layer, an intermediate layer, a green-sensitive silver halide emulsion layer, a yellow filter layer, a blue-sensitive silver halide emulsion layer which contained the additives described in Table 1 and an uppermost layer were applied in order, to prepare Samples 1 to 12. In the uppermost layer, acid-processed gelatin and the organic fluoro-compound indicated below in an amount of 2 g per 100 g of gelatin were employed as follows:

| Sample No. | Composition of Uppermost Layer |
|---|---|
| (1) | Acid-processed Gelatin |
| (2) | Lime-processed Gelatin |
| (3) | Acid-processed Gelatin + Organic Fluoro-compound (14) |
| (4) | Lime-processed Gelatin + Organic Fluoro-compound (14) |
| (5) | Acid-processed Gelatin + Organic Fluoro-compound (16) |
| (6) | Lime-processed Gelatin + Organic Fluoro-compound (16) |
| (7) | Acid-processed Gelatin + Organic Fluoro-compound (29) |
| (8) | Lime-processed Gelatin + Organic Fluoro-compound (29) |
| (9) | Acid-processed Gelatin + Organic Fluoro-compound (36) |
| (10) | Lime-processed Gelatin + Organic Fluoro-compound (36) |
| (11) | Acid-processed Gelatin + Organic Fluoro-compound (38) |
| (12) | Lime-processed Gelatin + Organic Fluoro-compound (38) |

Table 1

| Component | Red-Sensitive Emulsion Layer | Green-Sensitive Emulsion Layer | Blue-Sensitive Emulsion Layer | Intermediate Layer | Yellow Filer Layer |
|---|---|---|---|---|---|
| Color | 4-Chloro-1-hydroxy-N-dodecyl-2-naphthamide (0.88 g/m$^2$) | 1-(2,4,6-Trichlorophenyl)-3-3-(2,4-di-t-amylphenoxy)-acetamido benzamido-5-pyrazolone (0.75 g/m$^2$) | 3'-(2,4-Di-t-amylphenoxyacetamido-α-(4-methoxybenzoyl-acetanilide (1.31 g/m$^2$) | — | — |
| Spectral Sensitizer | bis-(9-Ethyl-5-chloro-3-β-hydroxyethyl)-thiacarbocyanine bromide (6.51 mg/m$^2$) | bis-(9-Ethyl-5-phenyl-3-ethyl)-oxy-carbocyanine isothiocyanate (5.23 mg/m$^2$) | — | — | — |
| Stabiliz-ing Agent (1) | (8.19 mg/m$^2$) | (7.71 mg/m$^2$) | (6.50 mg/m$^2$) | — | — |
| Hardening Agent (2) | (15 mg/m$^2$) | (14 mg/m$^2$) | (20 mg/m$^2$) | (10 mg/m$^2$) | (11 mg/m$^2$) |
| Coating Agent (3) | (42 mg/m$^2$) | (51 mg/m$^2$) | (67 mg/m$^2$) | (56 mg/m$^2$) | (63 mg/m$^2$) |
| Coating Agent (4) | (53 mg/m$^2$) | (64 mg/m$^2$) | (84 mg/m$^2$) | (71 mg/m$^2$) | (80 mg/m$^2$) |

Table 1-continued

| Component | Red-Sensitive Emulsion Layer | Green-Sensitive Emulsion Layer | Blue-Sensitive Emulsion Layer | Intermediate Layer | Yellow Filer Layer |
|---|---|---|---|---|---|
| | Silver halide emulsion: Silver iodobromide (silver iodide: 5.5 mol%) | | | — | Yellow colloidal Silver |
| | (2.85 g/m²) | (4.24 g/m²) | (3.71 g/m²) | | (0.124 g/m²) |
| Dry Thickness | 5 μ | 6 μ | 5 μ | 2 μ | 2 μ |

(1) 5-Hydroxy-7-methyl-1,3,8-triazaindolidine
(2) 2,4-Dichloro-6-hydroxy-1,3,5-triazine sodium salt
(3) Sodium p-dodecylbenzene sulfonate
(4) Sodium p-nonylphenoxypoly(ethyleneoxy)propane sulfonate To the above-described composition of the uppermost layer, per 1 g of the binder, 8.3 mg of the sodium salt of 2,4-dichloro-6-hydroxy-1,3,5-triazine as a hardening agent, 40 mg of liquid paraffin as a lubricating agent and 50 mg of the sodium salt of sulfosuccinic acid di(2-ethylhexyl)ether as a coating aid were added. The mixture was coated in a dry thickness of about 1.5 micron and dried at a temperature of 25° C. and a relative humidity of 60%.

The adhesion testing was carried out as follows. A sample was cut into a 4 cm square and conditioned at a temperature of 30° C. and a relative humidity of 80% for two days in a container. After conditioning, the cut samples were superposed so that the uppermost layer of one light-sensitive material contacted the back layer of another light-sensitive material, and they were kept in the same temperature and humidity conditions as above for one day under a pressure of 50 g/cm². Then the samples were separated and the area adhered was determined. Thus, the ratio of the adhered area was calculated as a percentage.

The results of the adhesion test with respect to Sample 1 to 12 are illustrated in Table 2.

Table 2

| | Sample No. | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Adhesion Area* (%) | 85 | 100 | 35 | 85 | 40 | 85 | 35 | 80 | 40 | 90 | 35 | 85 |

*Mean value of three test samples (hereinafter the same)

As is apparent from the above results, acid-processed gelatin has a better anti-adhesive property compared with alkali-processed gelatin. Also, when the organic fluoro-compound is added to the uppermost layer, the anti-adhesive property of the layer is improved even where alkali-processed gelatin is used in the uppermost layer. Furthermore, it is surprising that where the organic fluoro-compound is present in the uppermost layer using acid-processed gelatin much better results in the anti-adhesive property can be obtained than the results obtained from the individual use of acid-processed gelatin and the organic fluoro-compound. This fact would not be expected from the prior art.

EXAMPLE 2

In the same manner as described in Example 1 but using the following compositions for an uppermost layer, Samples 13 to 21 were prepared.

| Sample No. | Composition of the Uppermost Layer |
|---|---|
| (13) | Acid-processed Gelatin + Organic Fluoro-compound (14)* |
| (14) | Acid-processed Gelatin + Organic Fluoro-compound (14)** |
| (15) | Acid-processed Gelatin + Organic Fluoro-compound (14)*** |

-continued

| Sample No. | Composition of the Uppermost Layer |
|---|---|
| (16) | Acid-processed Gelatin + Organic Fluoro-compound (39)* |
| (17) | Acid-processed Gelatin + Organic Fluoro-compound (39)** |
| (18) | Acid-processed Gelatin + Organic Fluoro-compound (39)*** |
| (19) | Acid-processed Gelatin + Organic Fluoro-compound (18)* |
| (20) | Acid-processed Gelatin + Organic Fluoro-compound (18)** |
| (21) | Acid-processed Gelatin + Organic Fluoro-compound (18)*** |

*0.1 g of organic fluoro-compound per 100 g of gelatin
**2 g of organic fluoro-compound per 100 g of gelatin
***10 g of organic fluoro-compound per 100 g of gelatin To the above-described composition of the uppermost layer, per 1 g of the binder, 50 mg of mucochloric acid as a hardening agent, 20 mg of polydimethylsiloxane as a lubricating agent and 60 mg of sodium p-dodecylbenzene sulfonate as a coating aid were added. The mixture was coated in a dry thickness of about 1.5 microns and dried at a temperature of 25° C. and a relative humidity of 60%.

The adhesion test of these sample was carried out in the same manner as Example 1. The results obtained are shown in Table 3.

Table 3

| | Sample No. | | | | | | | | |
|---|---|---|---|---|---|---|---|---|---|
| | 13 | 14 | 15 | 16 | 17 | 18 | 19 | 20 | 21 |
| Adhesion Area (%) | 60 | 35 | 20 | 70 | 35 | 25 | 70 | 30 | 25 |

It can be understood from the results above that an anti-adhesive property can be obtained by using an organic fluoro-compound in an amount of 0.1 to 10 g per 100 g of the binder in the uppermost layer and improved anti-adhesive property is obtained.

EXAMPLE 3

In the same manner as described in Example 1 but using the following compositions for the uppermost layer, Samples 22 to 29 were prepared.

| Sample No. | Composition of the Uppermost Layer |
|---|---|
| (22) | Acid-processed Gelatin + PMMA |
| (23) | Acid-processed Gelatin + Organic Fluoro-compound (15)* + PMMA |
| (24) | Acid-processed Gelatin + Organic Fluoro-compound (15)** + PMMA |
| (25) | Acid-processed Gelatin + Organic Fluoro-compound (23)* + PMMA |
| (26) | Acid-processed Gelatin + Organic Fluoro-compound (23)** + PMMA |
| (27) | Acid-processed Gelatin + Organic Fluoro-compound (38)* + PMMA |
| (28) | Acid-processed Gelatin + Organic Fluoro-compound (38)** + PMMA |
| (29) | Lime-processed Gelatin + |

-continued

| Sample No. | Composition of the Uppermost Layer |
|---|---|
| | Organic Fluoro-compound (38)**+PMMA |

PMMA:
Polymethyl methacrylate having an average particle size of 1.2 micron in an amount of 2 g/100 g of gelatin
*2 g of the organic-fluoro-compound per 100 g of gelatin
**10 g of the organic fluoro-compound per 100 g of gelatin To the above-described composition of the uppermost layer, per 1 g of the binder, 20 mg of 1,3,5-triacryloylhexahydrotriazine as a hardening agent, 40 mg of liquid paraffin as a lubricating agent and 60 mg of sodium p-dodecylbenzene sulfonate as a coating aid were added. The mixture was coated and dried in the same manner as described in Example 1.

The adhesion test of these samples was carried out in the same manner as Example 1. The results obtained are shown in Table 4.

Table 4

| | Sample No. | | | | | | | |
|---|---|---|---|---|---|---|---|---|
| | 22 | 23 | 24 | 25 | 26 | 27 | 28 | 29 |
| Adhesion Area (%) | 70 | 5 | 0 | 5–10 | 0–5 | 5 | 0 | 75 |

It can be understood from the results above that the anti-adhesive property is remarkably improved when a matting agent is further added to an uppermost layer containing acid-processed gelatin and the organic fluoro-compound. Similar effects can also be obtained if a matting agent other than polymethyl methacrylate particles is used.

EXAMPLE 4

On to a polyethylene terephthalate film support were coated the following layers, in order:

First Layer: Red-sensitive silver halide emulsion layer: A coupler-free, high-speed gelatino silver iodobromide emulsion layer rendered red-sensitive with a sensitizing dye and coated at a silver coverage of 15 mg/100 cm$^2$.

Second Layer: Green-sensitive silver-halide emulsion layer: A coupler-free, high-speed gelatino silver iodobromide emulsion layer rendered green-sensitive with a sensitizing dye and coated at a silver coverage of 15 mg/100 cm$^2$.

Third Layer: Yellow filter layer: A gelatin layer containing a yellow colloidal silver dispersion and coated at a silver coverage of 25 mg/100 cm$^2$.

Fourth Layer: Blue-sensitive silver halide emulsion layer: A coupler-free, high-speed gelatino silver iodobromide emulsion layer coated at a silver coverage of 20 mg/100 cm$^2$.

On the resulting film were coated and dried, as a fifth layer, uppermost layers having the following compositions to provide Samples 30 to 38.

| Sample No. | Composition of Uppermost Layer |
|---|---|
| (30) | Lime-processed Gelatin + PMMA |
| (31) | Acid-processed Gelatin + PMMA |
| (32) | Lime-processed Gelatin + PMMA+ Organic Fluoro-compound (15) |
| (33) | Acid-processed Gelatin + PMMA+ Organic Fluoro-compound (15) |
| (34) | Acid-processed Gelatin + PMMA+ Organic Fluoro-compound (23) |

-continued

| Sample No. | Composition of Uppermost Layer |
|---|---|
| (35) | Acid-processed Gelatin + PMMA+ Organic Fluoro-compound (29) |
| (36) | Acid-processed Gelatin + PMMA+ Organic Fluoro-compound (36) |
| (37) | Acid-processed Gelatin + PMMA+ Organic Fluoro-compound (38) |
| (38) | Acid-processed Gelatin + Organic Fluoro-compound (38) |

PMMA: Polymethyl methacrylate having an average particle size of 1.2 microns in an amount of 2 g 100 g of gelatin.

The organic fluoro-compound was employed in an amount of 2 g/100 g of gelatin.

To the above-described composition of the uppermost layer, the same amounts of the hardening agent, the lubricating agent and the coating aid as described in Example 2 were added. The mixture was coated and dried in the same manner as described in Example 2.

The adhesion test of these samples was carried out in the same manner as Example 1. The results obtained are shown in Table 5.

Table 5

| | Sample No. | | | | | | | | |
|---|---|---|---|---|---|---|---|---|---|
| | 30 | 31 | 32 | 33 | 34 | 35 | 36 | 37 | 38 |
| Adhesion Area (%) | 85 | 70 | 70 | 0–5 | 0–5 | 0–5 | 0–5 | 0–5 | 35 |

Further Samples 30 to 38 were cut to a width of 8 mm and tested for adhesion to camera gates in the following manner:

After the samples, which were mounted in magazines for the single eight system, were allowed to stand for 2 hours in a room maintained at 35° C. and 90% relative humidity, the samples were loaded in cameras. Confirmation that the samples could move was made by operating the shutter. After standing for 5 minutes under the same humidity and temperature conditions, the cameras were driven again. If the surface of the film adhered firmly to the camera gate, the film did not move. The operations were repeated by exchanging cameras so that each sample was tested 3 times in each camera and 24 times in total, and the times where the film moved were counted. The results obtained are shown in Table 6.

Table 6

| | Sample No. | | | | | | | | |
|---|---|---|---|---|---|---|---|---|---|
| | 30 | 31 | 32 | 33 | 34 | 35 | 36 | 37 | 38 |
| Times Film Moved | 5 | 11 | 10 | 21 | 20 | 22 | 20 | 22 | 18 |
| Times Film Did Not Move | 19 | 13 | 14 | 3 | 4 | 2 | 4 | 2 | 6 |

From these results above it can be understood that excellent anti-adhesive property is again obtained by using an uppermost layer containing acid-processed gelatin and an organic fluoro-compound in a coupler-in-developer type reversal color film, and that such anti-adhesive property is observed not only for the back surface of the film but also for the front surface of the film contacting a camera gate.

EXAMPLE 5

In the same manner as described in Example 4 but using the following compositions for the uppermost layer, Samples 39 to 44 were prepared.

| Sample No. | Composition of Uppermost Layer |
|---|---|
| (39) | Acid-processed+PMMA+ORFL<br>Gelatin (100%) |
| (40) | Acid-processed Lime-processed<br>+ +PMA+ORFL<br>Gelatin (80%) Gelatin (20%) |
| (41) | Acid-processed Lime-processed<br>+ +PMMA+ORFL<br>Gelatin (60%) Gelatin (40%) |
| (42) | Acid-processed Lime-processed<br>+ +PMMA+ORFL<br>Gelatin (40%) Gelatin (60%) |
| (43) | Acid-processed Lime-processed<br>+ +PMMA+ORFL<br>Gelatin (20%) (Gelatin (80%) |
| (44) | Lime-processed<br>+PMMA+ORFL<br>Gelatin (100%) |

PMMA: Polymethyl methacrylate having an average particle size of 1.2 microns in an amount of 2 g/100 g of gelatin
ORFL: Organic Fluoro-compound (14) in an amount of 2 g/100 g of gelatin To the above-described composition of the uppermost layer, the same amounts of the hardening agent, the lubricating agent and the coating aid as described in Example 2 were added. The mixture was coated and dried in the same manner as described in Example 2.

The adhesion test of these samples was carried out in the same manner as in Example 1. The results obtained are shown in Table 7.

Table 7

| | Sample No. | | | | | |
|---|---|---|---|---|---|---|
| | 39 | 40 | 41 | 42 | 43 | 44 |
| Adhesion Area (%) | 0 | 0–5 | 10 | 35 | 60 | 70 |

Further, these samples were cut to a width of 8 mm and tested for adhesion to camera gates in the same manner as described in Example 4. The results obtained are shown in Table 8.

Table 8

| | Sample No. | | | | | |
|---|---|---|---|---|---|---|
| | 39 | 40 | 41 | 42 | 43 | 44 |
| Times Film Moved | 22 | 20 | 19 | 17 | 12 | 10 |
| Times Film Did Not Move | 2 | 4 | 5 | 7 | 12 | 14 |

From these results above it can be understood that the improvement in the anti-adhesive property is observed where the amount of acid-processed gelatin is about 20% or more by weight based on the total amount of the binder in the uppermost layer and where the amount of acid-processed gelatin is over about 40%, even more preferred results are obtained.

Furthermore, the films obtained by processing the samples described in Examples 1 to 5 provide good images without any adverse effect such as an increase the haze. Also, after an incubation test, these samples provide good images and no degradation of photographic properties and other properties due to the use of the uppermost layer according to the present invention is observed.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material containing an uppermost layer consisting essentially of acid-processed gelatin and a surface active organic fluoro-compound, wherein said organic fluoro-compound contains in the molecule thereof at least three fluorine atoms and a group in which at least three carbon atoms combine to form carbon-carbon bonds.

2. The photographic light-sensitive material as claimed in claim 1, wherein the amount of the organic fluoro-compound is about 0.1 to 10 g/100 g of the binder in the uppermost layer.

3. The photographic light-sensitive material as claimed in claim 1, wherein said uppermost layer contains a matting agent.

4. The photographic light-sensitive material as claimed in claim 1 comprising a support having thereon at least one silver halide emulsion layer and said uppermost layer.

5. The photographic light-sensitive material as claimed in claim 4, wherein said support has thereon a blue-sensitive silver halide emulsion layer containing a yellow color-forming coupler, a green-sensitive silver halide emulsion layer containing a magenta color-forming coupler and a red-sensitive silver halide emulsion layer containing a cyan color-forming coupler.

6. The photographic light-sensitive material as claimed in claim 1, wherein said organic fluoro-compound contains a chain structure or a cyclic structure and contains at least three fluorine atoms and at least three carbon atoms.

7. The photographic light-sensitive material as claimed in claim 1, wherein said uppermost layer contains a lubricating agent.

8. The photographic light-sensitive material as claimed in claim 1, wherein said uppermost layer contains another surface active agent.

9. The photographic light-sensitive material as claimed in claim 1, wherein said uppermost layer contains a hardening agent for the acid processed gelatin.

* * * * *